United States Patent [19]

Quiogue

[11] Patent Number: 4,472,768

[45] Date of Patent: Sep. 18, 1984

[54] BALLAST RETAINING BRACKET WITH PIVOTABLE MOVEMENT

[75] Inventor: Honesto D. Quiogue, Blacksburg, Va.

[73] Assignee: Harvey Hubbell Incorporated, Orange, Conn.

[21] Appl. No.: 335,084

[22] Filed: Dec. 28, 1981

[51] Int. Cl.[3] ..... F21S 1/06

[52] U.S. Cl. ..... 362/370; 362/294; 362/418; 362/371; 362/427; 362/375; 362/432; 362/376; 362/457; 248/320; 248/324

[58] Field of Search ..... 362/294, 373, 376, 432, 362/365, 368–370, 427, 430, 253, 362, 418, 371, 457, 458; 248/282, 320, 323, 324

[56] References Cited

U.S. PATENT DOCUMENTS

| | | | |
|---|---|---|---|
| 2,937,841 | 5/1960 | Bodian | 248/324 |
| 3,601,599 | 8/1971 | Sink | 362/432 X |
| 4,001,573 | 1/1977 | Derasp | 248/320 X |
| 4,054,790 | 10/1977 | Slaughter | 362/373 X |
| 4,057,211 | 11/1977 | Moore | 248/320 X |
| 4,086,479 | 4/1978 | Andrew | 362/432 X |
| 4,104,713 | 8/1978 | Chan et al. | 362/373 X |
| 4,152,757 | 5/1979 | Bilson et al. | 362/432 X |
| 4,234,916 | 11/1980 | Goralnik | 362/373 X |
| 4,245,284 | 1/1981 | Moore et al. | 362/432 X |
| 4,352,510 | 10/1982 | Saito et al. | 248/323 X |
| 4,356,540 | 10/1982 | Goralnik | 362/294 |

FOREIGN PATENT DOCUMENTS

| | | | |
|---|---|---|---|
| 3027961 | 2/1982 | Fed. Rep. of Germany | 362/432 |

*Primary Examiner*—Peter A. Nelson
*Attorney, Agent, or Firm*—Jerry M. Presson

[57] ABSTRACT

A bracket formed of a noncombustible material such as metal, serves as a restraint for a ballast transformer mounted in a combustible, electrical lighting fixture in the event the fixture is consumed by fire. The bracket has one end connected to the ballast and an opposite end encircling the free end of a conventional fixture-mounting bushing which is fixedly attached to a metal electrical outlet box. The bracket automatically attaches to the bushing once the fixture is mounted on the bushing and a cap nut is applied thereto.

10 Claims, 4 Drawing Figures

BALLAST RETAINING BRACKET WITH PIVOTABLE MOVEMENT

INTRODUCTION

This invention relates generally to electrical lighting fixtures and more particularly, to a fixture composed wholly or partially of polymeric material which employs a ballast transformer to energize the fixture lamp.

BACKGROUND OF THE INVENTION

Electrical lighting fixtures of the metal halide, mercury vapor and high pressure sodium types employ ballast transformers to provide appropriate electrical voltages and currents to energize the lamp or lamps mounted in the fixture. The enclosures or housings used in these fixtures may be composed wholly or partially of a polymeric material because of its relatively light weight and ease of moldability into esthetic designs.

The ballast is formed of a stack of flat laminations of magnetizable iron which are cut out in various shapes to receive one or more electrical coils. The ballast laminations are held together by screws or bolts which pass perpendicularly through the laminations adjacent each corner thereof. By virtue of their high metallic content, each ballast may weigh two or more pounds and if the fixture is largely composed of a polymeric material, there exists the possibility that the ballast is being retained on a polymeric supporting surface.

For lighting fixtures having housings comprised of polymeric materials, the Mar. 26, 1980 Underwriters Laboratory Code entitled "High Intensity Discharge Lighting Fixtures—UL 1572" under Subsection 54.1 thereof is relevant in its requirement that "A polymeric material, thermoplastic or thermosetting, used to provide all or any part of the enclosure for electrical parts . . . that provides structural support in a fixture, shall comply with the requirements of this section.".

The additional pertinent requirement is stated in Subsection 54.9 as follows: "Any nonpolymeric part that weighs more than 2 pounds (0.91 kg) shall be connected to the mounting means of the fixture by a metal chain, cable or equivalent.". A "nonpolymeric part" which falls within this definition would include a ballast.

A principal reason behind these requirements is that the mounting of the ballast to a polymeric part of the housing may create a hazardous situation if that part of the fixture is consumed by fire. In such case, the polymeric ballast might be released to fall freely from the fixture. As will be evident, a possible safety problem to firefighters can be created by ballasts falling from ceiling or wall mounted fixtures.

To prevent the ballast from falling from these types of fixtures in a fire situation, Underwriters Laboratory has, in effect, mandated that the ballast be connected to the fixture mounting means (which is typically the metal bridge or "hickey" of an electrical outlet box) by a "metal chain, cable or equivalent". As may be appreciated, the manual connection of chains and cables to the fixture mounting by the luminaire installer, who is typically an electrician, can, however, prove troublesome, time-consuming and in some cases, omitted deliberately or through oversight.

OBJECTS OF THE INVENTION

It is an object of the present invention to provide a new and improved means for limiting the fall of a ballast from a polymeric fixture housing which complies with the requirements of Underwriters Laboratory.

It is a further object of this invention to provide a ballast restraint which automatically couples to the fixture mounting when the fixture is mounted on a support.

SUMMARY OF THE INVENTION

According to this invention, there is provided an elongated, metal bracket having one end attached to one of the bolts which passes through the ballast to hold the ballast laminations together. The other end of the bracket is apertured to encompass the free end of an externally threaded, metal tubular bushing which mounts the fixture to an underlying metal outlet box when a cap nut is screwed onto that end of the bushing. With the instant bracket, the mounting of the fixture on the bushing with the cap nut automatically effects a mechanical connection between the bracket and its associated outlet box through the bushing. Should the support for the ballast be burned away, the ballast will be restrained against falling freely from the fixture by the bracket pivoting about the metal bushing.

The advantage of this arrangement is that no additional time, effort or consideration need be expended by the fixture installer to assure that the ballast is properly secured to the metallic outlet box. Moreover, the retaining bracket is completely enclosed within the fixture housing and thus does not detract from the esthetic appearance of the fixture.

DETAILED DESCRIPTION

Figures 1, 1A:
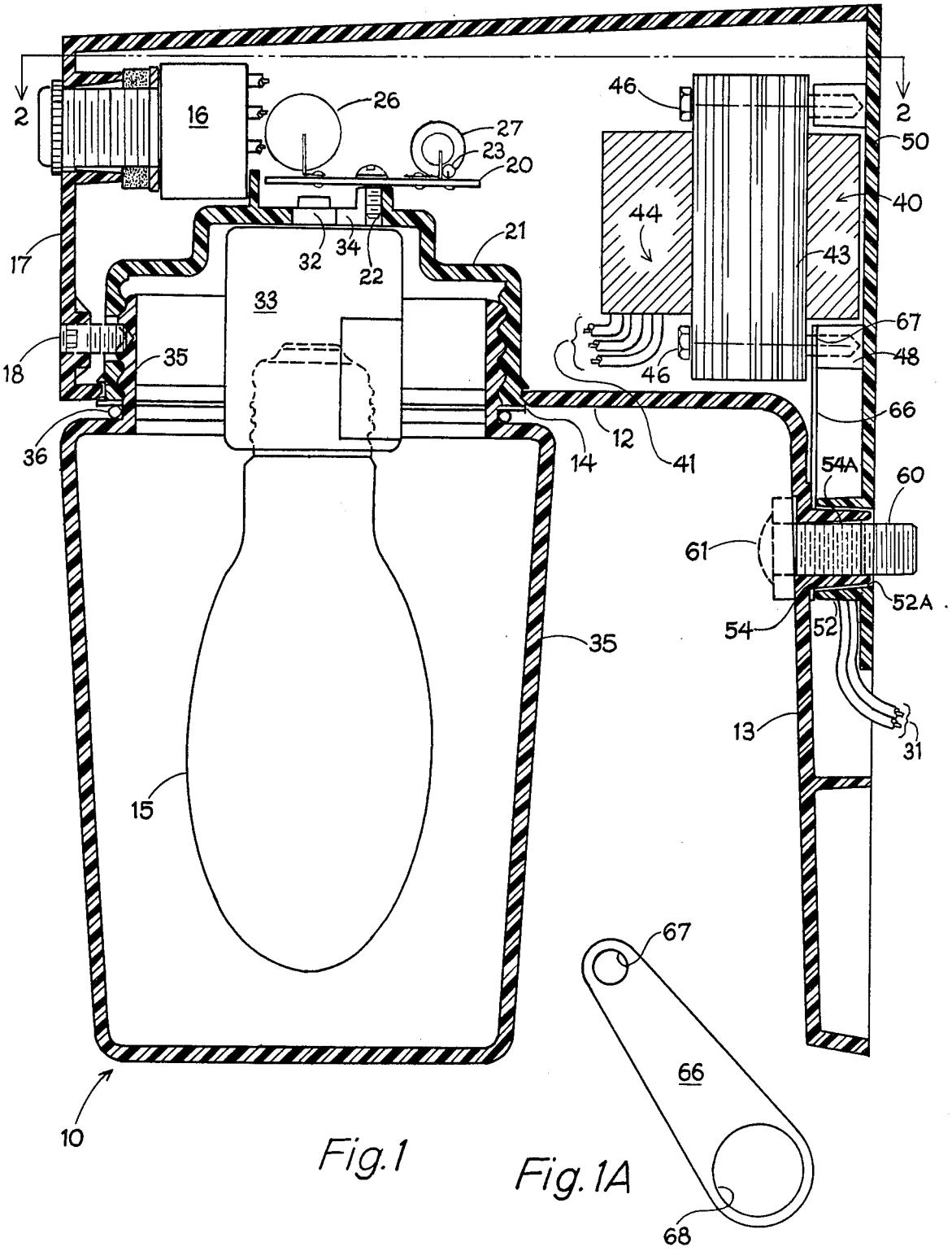
FIG. 1 is a sectional side view of a wall-mountable lighting fixture depicting a ballast attached to a retaining bracket which is constructed in accordance with the instant invention; the section being taken substantially midway through the fixture.
FIG. 1A is a plan view of the ballast-restraining bracket of this invention.
Figure 2:
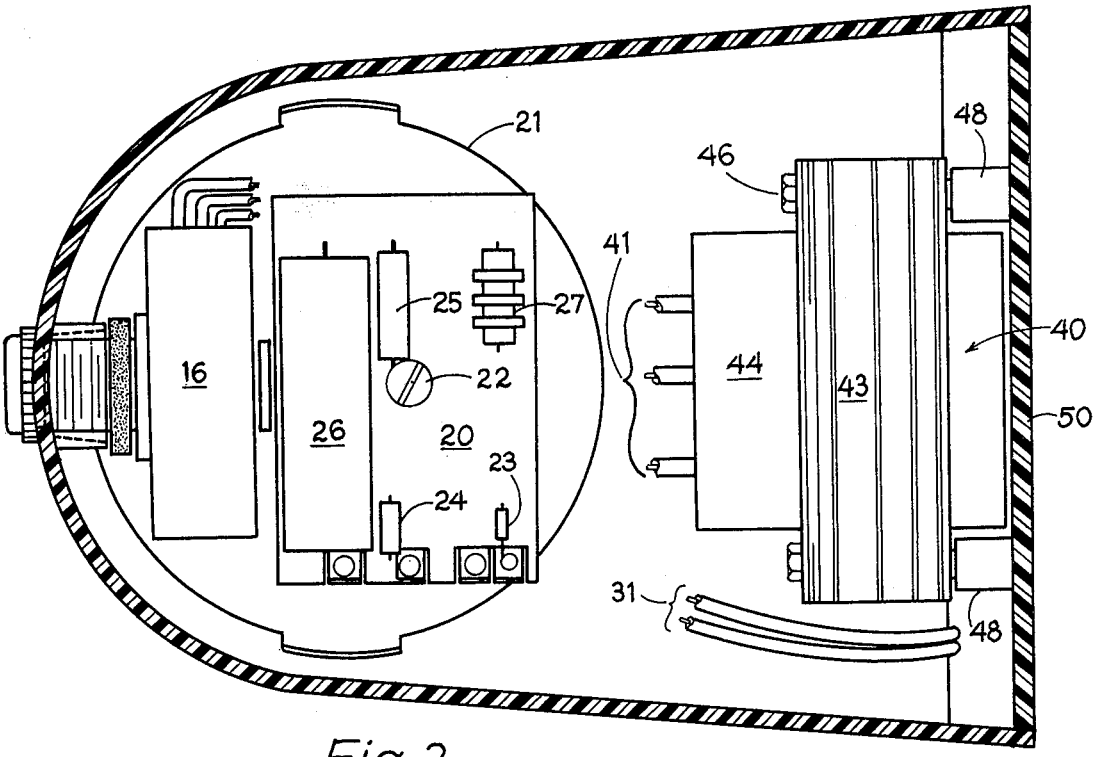
FIG. 2 is a plan view taken along section lines 2—2 of FIG. 1.
Figure 3:
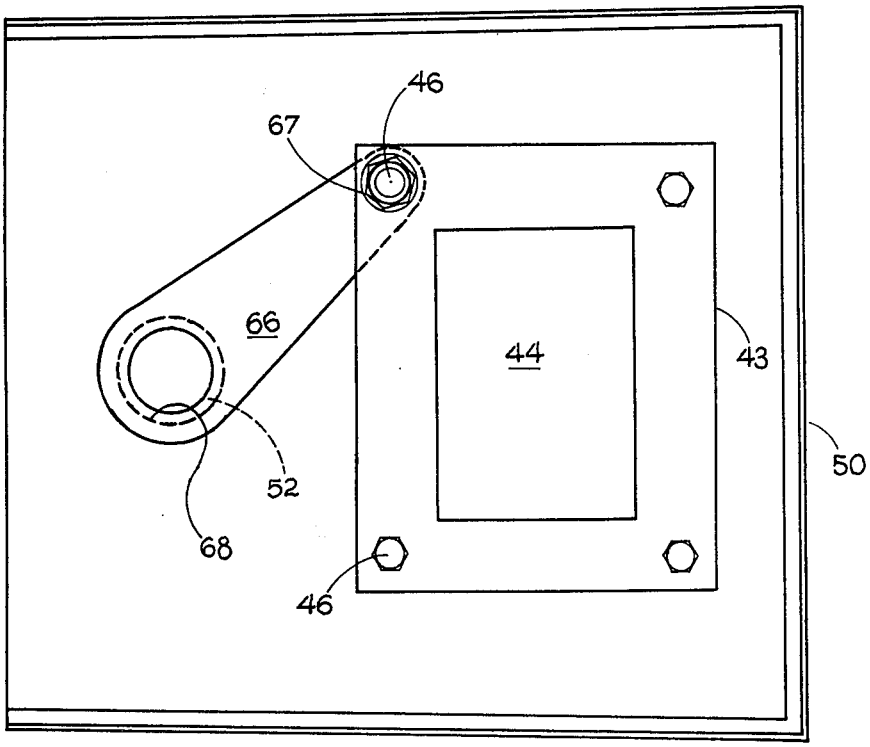
FIG. 3 is an end view of a subassembly part of the housing viewed from inside the fixture which mounts the ballast and its restraining bracket; the subassembly shown at right angles to its position in FIG. 1.

Referring to FIG. 1, there is shown a fixture 10 having a housing composed entirely of a polymeric composition; which may be of a thermoplastic or thermosetting type. Polycarbonate compositions are especially suitable for these applications. The housing comprises a horizontal leg 12 and a vertical leg 13, the leg 13 being designed for flush mounting against a vertical structural surface, such as paneling or wallboard.

The horizontal leg 12 has an opening 14 for receiving a lamp 15, the state of illumination of which may be optionally under the control of a conventional photoelectric control device 16 mounted in the outermost end 17 of the housing. The device 16 is coupled to the electrical energizing circuit of the lamp 15 by conventional circuitry.

The various electrical components employed in the operation of the lamp 15 may be mounted on an insulated board 20 mounted above the lamp socket housing 21 by any appropriate means, such as screw 22. Such components are conventional and typically include resistors 23, 24 and 27 and capacitors 25 and 26; these components comprising a lamp starting or energizing circuit. The voltages and currents are supplied to the lamp circuit by means of electrical conductors 31 connected to a suitable source of AC power. A center contact 32 of a lamp socket 33 is received in a polymeric cup portion 34 and is electrically connected by wires (not shown) to the components on the board 20 and to any other of the usual components required for the proper operation of the lamp 15.

A lamp enclosure or globe 35 of suitable optical characteristics is inserted into the leg 12, as illustrated, and an O-ring 36 provides a seal between the enclosure 35 and the opening 14 of the housing. The globe 35 is preferably composed of a transparent plastic, such as Lexan, and has its upper end threaded into the socket housing 21. The orientation of the globe about its vertical axis may be fixed by a set screw 18 mounted in the front end 17 of the housing.

Mounted within the fixture is a transformer ballast 40 having the usual electrical connections 41 to the lamp starter and energizing circuit. The ballast 40 is comprised of a stack of iron laminations 43 which are cut out appropriately to mount an electrical coil 44 thereon, as is well known. The particular type of ballast and its construction depends upon the specific type of lamp used in the fixture, and hence, various types of ballasts may be mounted in the fixture of this invention. In the event the ballast weighs more than 2 pounds, however, the necessity arises of complying with the Underwriters Laboratory requirements, referred to hereinabove.

The ballast laminations 43 are secured together by four bolts 46 which pass through all the plates and extend from the innermost lamination and threadedly engage individual, aligned support bosses 48 formed on a plate 50 comprising a ballast subassembly. The support bosses 48 are formed as a unitary part of the plate 50 which, with the ballast mounted on it, can be joined by ultrasonic welding, for example, on the rear of the fixture housing.

Located adjacent the lower end of the plate 50 is an inwardly extending, substantially cylindrical sleeve 52 also formed integral with the plate 50. Extending from the leg 13 opposite the sleeve 52 and in coaligned relationship therewith, is an another, substantially cylindrical sleeve 54. Extending axially through the sleeve 52 is a bore 52A having a slightly greater diameter than the outer diameter of the sleeve 54. The respective opposing surfaces of the sleeves 52 and 54 permit the sleeve 52 to slide over the sleeve 54 when the subassembly 50 is mounted on the back of the fixture. The free end of the sleeve 52 is spaced from the substantially vertical surface adjacent the sleeve 54 the thickness of one end 68 of a ballast restraining bracket 66, FIG. 1A.

The bore **54*a* extends axially through the sleeve 54 and is of a sufficient diameter to accommodate the insertion therethrough of a conventional, externally threaded tubular mounting member or bushing 60 onto which an internally threaded metal cap nut 61 can be threaded and tightened to hold the fixture firmly on the bushing 60** and against the underlying supporting wall or ceiling.

As is well known to those working in the art, the bushing 60 is typically composed of a metal, such as brass, and is designed to have one end screwed into a steel bridge plate (not shown) which is known to those in the art as a "hickey". The bridge plate is usually attached by metal screws (not shown) to a metal outlet box housing the electrical conductors which are to be connected to the lamp starting and energizing circuits in the fixture. The outlet box is, in turn, fixed to an appropriate supporting member by nails or screws.

In the event the polymeric mounting bosses 48 are burned away, the mounting bolts 46 would no longer be held to the fixture housing and the ballast 40 released to fall freely from its mounting. This condition could pose a hazard to fire fighters or anyone else under the ballast at that time.

In accordance with this invention, one end of the ballast 40 is restrained against falling freely by the bracket 66. The bracket 66 is composed of a strip of iron, steel or other noncombustible material and as may be best seen in FIG. 1A, has a bore 67 of circular section in its upper end which surrounds closely the threads on that portion of a bolt 46 extending between the boss 48 and the innermost plate of the ballast. The length of this portion of bolt 46 engaged by the bracket surface defining the bore 67 is long enough to ensure that the bolt will remain attached to the bracket 66 during and after any fall the ballast may take. If so desired, the bore 67 may be internally threaded to threadedly, and hence more positively, engage the threads of the bolt 46 and the bore 67 insulated electrically from the ballast by bushings (not shown) composed of an electrical insulating material, such as rubber. The bracket 66 is mounted entirely within the leg 13 and therefore is not accessible from the outside of the fixture. Thus, the presence of the bracket is hidden from view and does not detract from the esthetic appearance of the fixture.

The opposite end of the bracket 66 has bore 68 extending through it which is slightly greater in diameter than the diameter of the cylindrical outer surface of the sleeve 54 and is smaller in diameter than the opposite, cross-sectional dimension of the cap nut 61. Hence, the annular surface defining the bore 68 surrounds closely the outer surface of the sleeve 54 and therefore does not interfere with either the insertion of the sleeve 54 over the threaded end of the bushing 60, or conversely, the insertion of the tube 60 through the sleeve 54.

In the event the fixture 10 disintegrates and the ballast 40 is released from its mounting bosses 48, the bracket 66 can pivot downwardly through an arc of about 135 degrees having its pivotal center substantially coincident with the axis of the bushing 60. After undergoing this rotation, the bracket suspends the ballast on the mounting bushing so that it does not fall any further from the fixture.

The advantage of this arrangement, as will be apparent, is that a positive ballast restraint is automatically effected once the fixture is mounted on its underlying outlet box in a conventional way and no special effort or consideration need be made to effect that restraint.

While one advantageous embodiment has been chosen to illustrate the invention, it will be understood by those skilled in the art that various changes and modifications can be made therein without departing from the scope of the invention as defined in the appended claims.

I claim:

1. A lighting fixture comprising a housing composed at least in part of a polymeric material and a fixture mounting means composed of a noncombustible material for mounting the fixture fixedly on a support and having a threaded end, the housing having an opening into which the threaded end of the mounting means extends, and a ballast mounted on the polymeric part of the housing, wherein the improvement comprises:

an elongated member located within the housing and composed of a noncombustible material for limiting the extent to which the ballast can fall freely from the fixture, said member extending radially from the threaded end of the mounting means and having opposite first and second ends, the first end of said member connected to the ballast and the second end of said member having a portion thereof at least partially surrounding the housing opening, said portion of said second end of said member mounted for free rotation on the mounting means, whereby the free fall of the ballast can be limited by the member pivoting about the mounting means in the event the housing is consumed by fire.

2. The fixture according to claim 1, wherein said elongated member comprises a metal bracket, and further, wherein the fixture mounting means comprises a tubular member having a longitudinal axis and an externally threaded end for attachment to a cap nut.

3. The fixture according to claim 2, wherein said bracket has a substantially rectangular cross-section, and extends radially from said tubular member when the major surface portion of said bracket oriented substantially perpendicular to said longitudinal axis of said tubular member.

4. The fixture according to claim 3 wherein the ballast is mounted on the housing by threaded fasteners extending therefrom and wherein said first end of said bracket has an opening extending therethrough defined by a substantially cylindrical wall portion which receives a length of one of said threaded fasteners.

5. The fixture according to claim 2 wherein said threaded end of said tubular mounting member extends from the housing opening and wherein the said portion of said bracket is formed by a bore extending through said second bracket end, and further wherein the cap nut has a cross-sectional dimension greater than the diameter of the bore in the second bracket end, whereby said second bracket end is retainable on the tubular member by the cap nut.

6. The fixture according to claims 1 or 5, wherein the ballast is comprised of a plurality of parallel, laminar plates and wherein said housing comprises a first housing portion and a second housing portion, both of the housing portions composed of the polymeric material, one of said housing portions including a ballast mounting plate having a plurality of spaced-apart ballast mounting bosses projecting therefrom, each of said bosses having an internal opening for threadedly receiving the end of at least certain ones of said fasteners extending from the ballast, whereby said bosses fixedly mount the ballast on the fixture housing.

7. The fixture according to claim 6 wherein said first portion of the fixture includes a first sleeve having a bore formed therein with the major axis thereof substantially parallel to said longitudinal axis of the tubular mounting member, the first sleeve bore having a greater diameter than the threaded end of said mounting member, whereby said threaded end is insertable axially through said first sleeve bore when the fixture is mounted, and an exterior wall formed on said first sleeve of substantially cylindrical shape for mounting within the bore of said second end of said bracket.

8. The fixture according to claim 7 wherein said ballast mounting plate comprises a second sleeve mounted in an overlapping relationship with said first sleeve, said second sleeve spaced from said first portion of the fixture to define an annular space therebetween for accommodating said second end of said bracket.

9. The fixture according to claim 8 wherein said second sleeve has a cross-sectional area greater than the cross-sectional area of the bore in said second bracket end, whereby said second bracket end is retained on said cylindrical wall of said first sleeve by the end of said second sleeve.

10. The fixture according to claim 9 wherein the first and second housing portions are substantially perpendicular, the first housing portion adapted to be mounted on a vertical supporting structure and the second housing portion mounting a lamp energizable by the ballast, and wherein the ballast is mounted above said second end of said bracket.

* * * * *